United States Patent [19]

Seiler

[11] Patent Number: 4,469,139

[45] Date of Patent: Sep. 4, 1984

[54] DOUBLE LIFT OPEN SHED JACQUARD LOOM

[75] Inventor: Wolfgang Seiler, Mönchen-Gladbach, Fed. Rep. of Germany

[73] Assignee: Firma Oskar Schleicher, Mönchen-Gladbach, Fed. Rep. of Germany

[21] Appl. No.: 362,257

[22] Filed: Mar. 26, 1982

[30] Foreign Application Priority Data

Apr. 3, 1981 [DE] Fed. Rep. of Germany ..... 3113433

[51] Int. Cl.[3] ..... D03C 3/08; D03C 3/24

[52] U.S. Cl. ..... 139/65; 139/59

[58] Field of Search ..... 139/59–65, 139/85

[56] References Cited

U.S. PATENT DOCUMENTS 3,289,707 12/1966 Wittendal ..... 139/63
3,480,044 11/1969 Servillat ..... 139/59
3,967,652 7/1976 Seiler ..... 139/59
4,060,101 11/1977 Seiler ..... 139/65

FOREIGN PATENT DOCUMENTS 51548 5/1982 European Pat. Off. ..... 139/65
840795 7/1960 United Kingdom ..... 139/65

*Primary Examiner*—James Kee Chi
*Attorney, Agent, or Firm*—Sommer & Sommer

[57] ABSTRACT

A double-lift open-shed Jacquard loom comprises hooks controlled by control needles, the leg of each hook having three noses thereon. The loom also has two sets of blades which are movable towards and away from each other by lift means, a stationary set of blades, and at least one hook rake. Bracing means are provided to act on the legs of the ones of said hooks which are disposed on the arresting blades in the open-shed position, to urge said hooks towards the respective lifting blade.

4 Claims, 4 Drawing Figures

DOUBLE LIFT OPEN SHED JACQUARD LOOM

BACKGROUND OF THE INVENTION

The present invention relates generally to a Jacquard machine and more particularly to a double-lift open-shed Jacquard machine.

One form of such a machine comprises a plurality of hooks which are controlled by respective control needles, with each hook having a leg portion with three noses or projections disposed thereon. The machine further comprises two sets of knives or blades which are movable in opposite directions towards or away from each other by suitable lifting means, a stationary set of arresting knives or blades, as well as at least one hook rake.

In such a machine, the hooks when supported on the arresting blades may be caused to oscillate and vibrate at high operating speeds. The result of such movement of the hooks may be that the rising lifting blades miss the corresponding hook noses, resulting in defective operation of the machine and defects in the article being produced.

SUMMARY OF THE INVENTION

An object of the present invention is to provide a new and improved Jacquard loom.

Another object of the present invention is to provide a double-lift open-shed Jacquard loom wherein the legs of hooks supported on the arresting blades do not suffer from oscillation or vibration in the open-shed position thereof.

Yet another object of the present invention is to provide a double-lift open-shed Jacquard loom which includes means to ensure that hooks to be lifted are reliably engaged by the respective lifting blades.

In accordance with the present invention, these and other objects are achieved by a double-lift open-shed Jacquard loom comprising a plurality of hooks which are controlled by control needles, with each hook having hook noses or projections on a leg of that hook. The loom further comprises two sets of blades or knives which are movable in opposite directions towards and away from each other by suitable lifting means, and a stationary set of arresting blades. The loom further includes at least one hook rake for guiding and holding separate from each other, the hooks associated therewith. Means are also provided, which are adapted to cooperate with respective hooks when supported on the arresting blades in the open shed position of the machine, to brace said hooks towards the respective lifting blades, by acting against the legs of the respective hooks which carry the hook noses. This bracing between the lifted hook legs and the bracing means ensures that the lifting blade required to lift a respective hook will always reliably engage the noses thereon.

An advantageous embodiment of the invention may provide that the bracing or support means comprises projections disposed on the legs of the respective hooks, the projections being adapted to fix the legs of hooks which are supported on the arresting blades in the open-shed position, in a hook rack, in the longitudinal direction of the needles. The projections are of such a configuration as not to prevent pivotal movement of the legs of the hooks in the lower-shed positions.

Another aspect of this feature of the present invention may provide that the legs of the hooks comprise round wire. Reinforcing means of round wire, extending along the legs of the hooks are provided for stabilising the hooks. The projection on each hook, as referred to above and forming the bracing means, is a part of the reinforcing means. The advantage of such a reinforcing means extending along the respective leg of the hook is that the leg of the hook has a high level of inherent stiffness and is thus less susceptible to vibration and oscillation.

A further feature of the present invention also advantageously provides that the bracing means comprise support elements, which are disposed at a stationary location above the upper set of blades, for acting on the upper end portion of the legs of the respective hooks. With this construction, it is also possible for the legs of the hooks to be provided with reinforcing means.

Further features, objects and advantages of the present invention will be apparent from the description hereinafter of embodiments of the loom as illustrated in diagrammatic form in the drawing.

DESCRIPTION OF THE PREFERRED EMBODIMENTS

Figure 1:
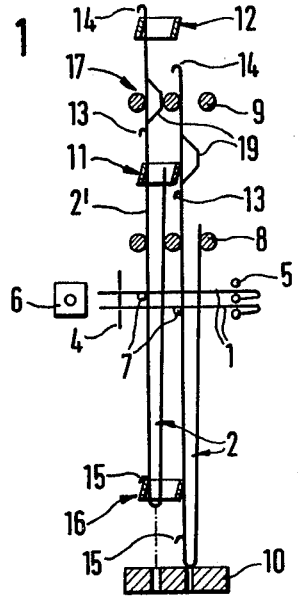
FIG. 1 is a diagrammatic view of a Jacquard loom, showing only two control needles and two hooks, for the sake of clarity, the hook shown on the left in the drawing being supported on the arresting blade, in the open-shed position.
Figure 3:
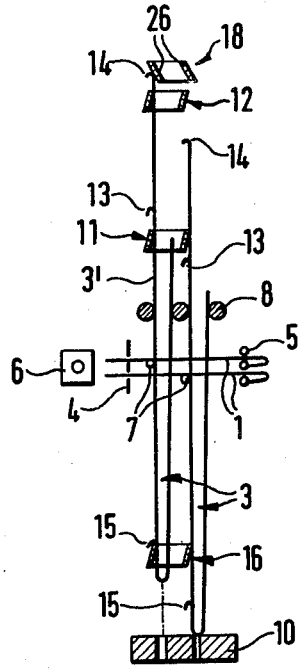
FIG. 3 shows a view corresponding to FIG. 1 of a further embodiment of the machine according to the invention.

Referring firstly to FIGS. 1 and 3, shown therein are two control needles and two hooks 2 and 3 of a Jacquard machine. The control needles 1 are mounted in a needle board 4 and a needle rake 5. The control needles are controlled in the usual manner by means of a card prism or needle control mechanism, diagrammatically indicated at 6. Pulses from the mechanism 6 are transmitted to the hooks 2 and 3 respectively by angular projections 7 which are disposed on the control needles. In the embodiment shown in FIG. 1, the hooks 2 and 3 are guided between a lower hook rake 8 and an upper hook rake 9, and are supported in the rest position on a stationary hook bottom member 10.

It will be noted at this point that the embodiment shown in FIG. 3 also has a hook rake 8, but is not illustrated as having a further upper hook rake 9. However, the embodiment shown in FIG. 3 may also be provided with an upper hook rake as indicated at 9, corresponding to the double hook rake structure shown in FIG. 1.

Disposed above the lower hook rake 8 is a lower set 11 of blades or knives as indicated at 11, and an upper set of blades or knives as indicated at 12. The purpose of the sets of blades 11 and 12 is to carry hooks which have not been urged away by the control needles 1 into the upper-shed position or correspondingly actuated hooks into the lower-shed position. For that purpose, each of the hooks has hook projections or noses 13 and 14 on a respective leg thereof. In the open-shed position, the hooks are supported by means of a further nose or projection 15 on a set 16 of arresting blades, which are disposed below the control needles 1. The two sets of blades 11 and 12 are arranged so as to move in opposite directions towards and away from each other, without crossing. In addition, the machine includes means for deflecting the hook noses away from the blades coming towards them, in the usual manner, for example the upper set of blades may be additionally arranged so as to be horizontally movable, in addition to being vertically-movable.

Referring now to FIG. 1 and FIG. 3, the machine according to the principles of the present invention has support or bracing means, which are indicated at 17 in FIG. 1 and at 18 in FIG. 3. In relation to hooks which are in the open-shed position and which are thus supported on the arresting blades 15, being the case for example with the hooks 2 or 3 shown at the left in each of FIGS. 1 and 3, the means 17, 18 act on legs 2' and 3', respectively, which carry the noses 13, 14 and 15, in such a way that they are disposed in the region of engagement of the respective lifting blades 11 and 12, respectively, in order reliably to be lifted thereby. This arrangement thus ensures that, particularly at high operating speeds of the machine, the legs 2' and 3' respectively of the hooks do not suffer from vibration and are not disposed outside the region for engagement by the respective lifting blades 11 and 12, just at the moment at which they are to be engaged by the lifting blades.

It will be appeciated that there are a number of possible forms of such support or bracing means. Referring to FIG. 1 which shows one possible construction, it will be seen that the legs 2' of the hooks 2 have projections, indicated at 19. Reference should now also be made to FIG. 2 which shows, in relation to the hook **2*a* illustrated therein, that the leg 2*a'* thereof may comprise two round wires which are welded together or secured together in some suitable manner, as at 20, 21 and 22. One round wire member as indicated at 23 forms the leg proper of the hook 2*a* and carries the noses 13, 14 and 15, while the other round wire member as indicated at 24 is disposed to act as a reinforcing means extending along the length of the leg 2*a'* and provides the projection 19*a*, which is operative as the support or bracing means. As can be clearly seen from FIG. 2, the round wire member 23 forming the hook 2*a* proper, is bent over to form a further but shorter spring leg 25** in the usual manner.

The mode of operation of the arrangement, and more particularly the bracing means 17, shown in FIG. 1 is as follows:

When a hook rises from the lower-shed position into the open-shed position, the leg 2' or **2*a'* thereof bears against the bar member of the hook member 9, which is shown furthest on the left in FIG. 1, while the projection 19 bears against the bar member of the rake 9, which is shown in the center in FIG. 1. This cooperation between the hook, projection 19 and rake 9 ensures that the leg of the hook cannot be subjected to a resilient oscillating movement between the bar members of the rake 9, so that the leg of the hook is fixed relative to the lifting blades 11 and 12**, respectively, in a position which permits the respective lifting blade reliably to engage into the hook nose for lifting of the hook.

Figure 2:
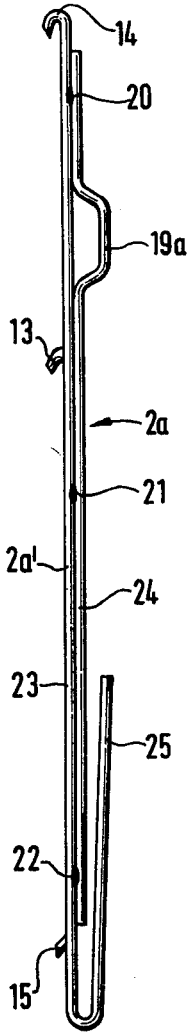
FIG. 2 shows another embodiment of the hooks illustrated in FIG. 1.
Figure 4:
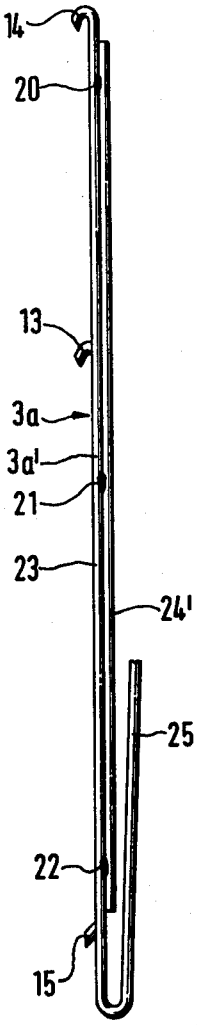
FIG. 4 shows an example of a hook which can be used in the machine shown in FIG. 3.

Referring now to FIG. 3, the bracing means 18 illustrated therein is in the form of support members 26 which are disposed at a stationary location above the upper set 12 of blades and which are adapted to act on the upper end portion of the leg 3' of the lifted hook 3, in the region of the nose 14 thereon. In the illustrated embodiment, the support members 26 are formed in the manner of a stationary set of blades or knives. Reference will now be made to FIG. 4, which shows a hook **3*a* of this embodiment in greater detail. Similarly to the hook 2*a* shown in FIG. 2, the hook 3*a* in FIG. 4 is provided with a reinforcing means extending along the length of the leg 3*a'* of the hook, which carries the hook noses 13 through 15. The FIG. 4 hook also comprises a round wire member 23, to which a further round wire member 24' forming the reinforcing means is secured, as by welding at 20, 21 and 22. The only difference of substance between the hook shown in FIG. 4 and the hook shown in FIG. 2 is that in this case the reinforcing member 24' does not have a projection 19*a***.

The mode of operation of the arrangement shown in FIG. 3, which can use a hook as shown in FIG. 4, is that when a hook rises from the lower-shed position into the upper-shed position shown at the left in FIG. 3, the upper end of the lifted hook comes to bear against the associated support member 26 whereby the leg of the hook is fixed in position relative to the lifting blades 11 and 12 respectively, for lifting engagement therewith.

It will be appreciated that the constructions described hereinbefore with reference to the drawing are described only by way of preferred embodiments of the invention and that various other modifications and alterations may be made therein without thereby departing from the scope and spirit of the present invention.

What is claimed is:

1. In a double-lift open-shed Jacquard loom having a vertically-movable hook, said hook having a leg portion provided with first, second and third noses thereon, having a first blade arranged to selectively engage said first nose, having a second blade arranged to selectively engage said second nose, and having a third blade arranged to selectively engage said third nose, having lifting means for moving said first and second blades upwardly and downwardly in opposite directions towards and away from one another, having a member, and having a control needle for selectively determining which of said blades will engage the associated nose, the improvement which comprises:

bracing means acting between said member and said hook only when said third blade engages said third nose for biasing said leg portion laterally such that said first and second noses will be held in operative positions at which they may be selectively engaged by the associated blades.

2. The improvement as set forth in claim 1 wherein said member is a hook rake, and said bracing means includes projections mounted on said leg portion so as to engage said hook rake.

3. The improvement as set forth in claim 1 wherein said bracing means includes a length of wire, having a portion bent to engage said member, mounted on said leg portion.

4. The improvement as set forth in claim 1 wherein said bracing means is a stationary member arranged to engage the upper end of said hook when said third blade engages said third nose.

* * * * *